US006479444B1

(12) United States Patent
Porticos et al.

(10) Patent No.: US 6,479,444 B1
(45) Date of Patent: Nov. 12, 2002

(54) FOAMING DRAIN CLEANER

(75) Inventors: Richard Porticos, Los Altos, CA (US); Michael H. Robbins, Hilden (DE); Inderjeet Ajmani, Fremont, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/762,428

(22) PCT Filed: Jul. 8, 1999

(86) PCT No.: PCT/US99/15514

§ 371 (c)(1),
(2), (4) Date: Feb. 6, 2001

(87) PCT Pub. No.: WO00/12672

PCT Pub. Date: Mar. 9, 2000

(51) Int. Cl.[7] ..... C11D 77/04
(52) U.S. Cl. ..... 510/195
(58) Field of Search ..... 510/195

(56) References Cited

U.S. PATENT DOCUMENTS

| | | | |
|---|---|---|---|
| 3,506,582 | A | 4/1970 | Gertzmann |
| 3,557,004 | A | 1/1971 | Yolles |
| 3,632,516 | A | 1/1972 | Antonelli et al. |
| 3,669,891 | A | 6/1972 | Greenwood et al. |
| 3,905,909 | A | 9/1975 | Bauer |
| 3,936,385 | A | 2/1976 | Cheng |
| 3,968,048 | A | 7/1976 | Bolan |
| 3,997,459 | A | 12/1976 | Bogie et al. |
| 4,060,433 | A | 11/1977 | Chunat et al. |

(List continued on next page.)

FOREIGN PATENT DOCUMENTS

| | | | |
|---|---|---|---|
| CN | WO94/21535 | 9/1994 | ..... B63D/81/32 |
| GB | 9325046.2 | 12/1993 | |
| GB | 9413098.6 | 6/1994 | |
| GB | 9406972.1 | 8/1994 | |
| GB | 9415908.4 | 8/1994 | |
| JP | 58-191800 | 11/1983 | ..... C11D/3/39 |
| JP | 59-24798 | 2/1984 | ..... C11D/7/18 |
| JP | 59-164399 | 9/1984 | ..... C11D/7/60 |
| JP | 60-13897 | 1/1985 | ..... C11D/7/60 |
| JP | 60-38497 | 2/1985 | ..... C11D/3/60 |
| JP | 7-18298 | 1/1995 | ..... C11D/7/54 |
| WO | WO 95/16023 | 6/1995 | ..... C11D/17/04 |
| WO | WO98/33880 | 8/1998 | ..... C11D/3/39 |

*Primary Examiner*—Yogendra N. Gupta
*Assistant Examiner*—John M. Petruncio
(74) *Attorney, Agent, or Firm*—Michael J. Mazza

(57) ABSTRACT

A composition is provided comprising two liquids which are separately maintained prior to forming an admixture during delivery to a surface to be treated, whereupon the admixture generates a foam sufficient for cleaning efficacy and stability. A first liquid preferably includes a hypohalite, or a hypohalite generating agent and a second liquid preferably includes a peroxygen agent. As the two liquids are initially separated, the hypohalite generating agent can be maintained in an environment free of peroxygen agent and otherwise conducive to their cleaning activity and stability up to the time of use. When the two liquids are allowed to mix, for example, by simultaneously pouring into a drain, the hypohalite and peroxygen react to liberate oxygen gas. As foam generation occurs, the escaping gas contacts surfactant in the solution, and creates foam which expands to completely fill the drain pipe. The expanded foam contains an excess of the hypohalite, which acts to clean the drain. A method of cleaning drains is provided which comprises the step of pouring into a drain at least one liquid which generates foam in situ, the foam characterized by a density of at least about 0.1 g/ml, a half life of greater than about thirty minutes, a volume of at least about 500 ml, and wherein the foam contains a cleaning-effective amount of a drain cleaning active.

8 Claims, 1 Drawing Sheet

U.S. PATENT DOCUMENTS 4,060,494 A 11/1977 Schoenhulz et al.
4,088,596 A 5/1978 Arai et al.
4,155,868 A 5/1979 Kaplan et al.
4,206,068 A 6/1980 Davis
4,388,204 A 6/1983 Dimond et al.
4,540,506 A 9/1985 Jacobsen et al.
4,619,710 A 10/1986 Kuenn et al.
4,664,836 A 5/1987 Taylor, Jr. et al.
4,666,625 A 5/1987 Shaer et al.
4,773,562 A 9/1988 Gueret
4,800,036 A 1/1989 Rose et al.
5,011,538 A 4/1991 Smith
5,264,146 A 11/1993 Tobiason et al.
5,389,157 A 2/1995 Smith
5,407,595 A 4/1995 Kamiya
5,443,656 A 8/1995 Burrows et al.
5,630,883 A 5/1997 Steer et al.
5,767,055 A 6/1998 Choy et al.
5,804,546 A 9/1998 Hall et al.
5,931,172 A 8/1999 Steer et al.

FOAMING DRAIN CLEANER

BACKGROUND OF THE INVENTION

1. Field of the Invention

The present invention relates to foaming cleaning compositions, and in particular to an in-situ foaming cleaning composition incorporating a bleach and which is formulated to have utility as a drain cleaner, or as a hard surface cleaner.

2. Description of Related Art

U.S. Pat. No. 5,084,546 to Hall discloses a personal care product, specifically a foaming shower gel. As such, the foam-generating components must be biologically compatible. Accordingly, Hall teaches only citric acid and a carbonate or bicarbonate to generate carbon dioxide gas. Nothing is mentioned which would suggest a peroxide/hypochlorite system, nor is use in surface cleaning or drain opening disclosed. Published Japanese applications to Ishimatsu et al JP 59-24798 and JP 60-32497; JP 59-164399, to Miyano et al; and Sakuma, JP 57-74379 all disclose, describe and claim a binary foaming cleaner having utility as a drain opener. Miyano et al specifically describes the advantages of a foam in drain opening. Ishimatsu et al and Miyano et al both describe an aqueous peroxide solution containing 0.25–25% active, paired with an aqueous solution of 0.25–6% hypochlorite, and both references teach the inclusion of surfactants with either or both solutions to enhance foaming. None of these references, however, teach, suggest or disclose a thickened formulation, nor any of the advantages and foam characteristics associated therewith.

A hypochlorite composition paired with a chelating agent/builder solution in a dual chamber container is disclosed in U.S. Pat. No. 5,767,055 to Choy et al.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Tobiason, U.S. Pat. No. 5,264,146, Steer, et al, U.S. Pat. No. 5,630,833 and Taylor, Jr. et al., U.S. Pat. No. 4,664,836 all disclose dry compounds which generate foam when mixed with water in a drain. Kuenn, U.S. Pat. No. 4,691,710 describes a dry in-sink garbage disposal cleaning composition which uses adipic acid and sodium bicarbonate to generate gas upon contact with water. This composition requires mechanical shearing from the disposal to assist in foam generation. Davis, U.S. Pat. No. 4,206,068 describes an exothermic drain opening composition comprising an oxidant and a reducing agent in a compartmentalized container.

SUMMARY OF THE PRESENT INVENTION

In view of the prior art, there remains a need for a foam generating cleaning composition capable of delivering a high percentage of active and possessing a long contact time on non-horizontal surfaces. There further remains a need for an in-situ foam-generating composition which is stable during storage and can be economically formulated.

It is another object of the present invention to provide a composition capable of forming an active-carrying foam in-situ.

It is another object of the present invention to provide a composition capable of generating a stable foaming active cleaner.

It is another object of the present invention to provide a dual component composition and containment means which isolates each component during storage.

It is another object to provide a drain opening composition which is formulated to be safe to store and use.

It is another object of the present invention to provide a composition capable of producing an active-containing foam which can reach all affected parts of a drain.

It is another object of the present invention to provide a foaming cleaning composition having utility as a drain cleaner by virtue of a viscoelastic rheology.

It is yet another object of the present invention to provide a drain cleaning composition which is highly effective.

It is yet another object of the present invention to provide a cleaning composition which is stable during normal storage, and at elevated or very low temperatures.

It is yet another object of the present invention to provide a composition having a viscoelastic rheology and a long relaxation time to provide beneficial flow properties during dispensing.

More specifically, the composition is a product of two liquids which are separately maintained prior to forming an admixture during delivery to a surface to be treated, whereupon the admixture generates a foam sufficient for cleaning efficacy and stability. A first liquid includes an oxidant, preferably a hypohalite or a hypohalite generating agent (hereinafter "hypohalite") and a second liquid includes a gas generating agent, preferably a peroxygen containing or releasing agent. As the two liquids are initially separated, the oxidant can be maintained in an environment free of gas generating agent and otherwise conducive to their cleaning activity and stability up to the time of use. When the two liquids are allowed to mix, for example, by simultaneously pouring into a drain, the hypohalite and peroxygen react to liberate oxygen gas in accordance with the following reaction equation:

$$NaOCl+H_2O_2 \rightarrow O_2(g)+NaCl+H_2O$$

The liberated gas contacts surfactant in the solution, creating foam which expands to completely fill the drain pipe. The expanded foam contains an excess of the hypohalite, which acts to clean the drain. The resulting foam is stable, and preferably characterized by a density of greater than about 0.1 g/ml, a percentage active of about 0.5–15, a half life of greater than about 30 minutes; a volume of greater than about 500 ml; and an initial foam development rate of about 10–50 ml/sec. Foam stability is defined as the foam's resistance to a force tending to collapse or displace the foam. The foam is further characterized by a ratio of foam:liquid of at least 1:1, preferably 2:1, more preferably 3:1; and a foam height sufficient to yield a greater than twelve cm. column in the drain (as measured from the center, or lowest point of the P-trap, and for a 3.2 cm. diameter drain), more preferably greater than seventeen cm. and most preferably seventeen to thirty-one cm. Most preferred in terms of foam volume and height in the drain, is an amount sufficient to reach the drain's stopper mechanism, a site of frequent hair and/or soap contamination. Such stopper mechanisms are typically positioned about twenty cm. up the vertical pipe. The foam would preferably contain greater than 0.1% active, more preferably greater than 0.5% active, and most preferably between about 0.75 and 3% active. An active contact time, or foam half life, should be between 0.5 and 4.0 hours preferably between 1 and 8 hours. Foam half life is the time elapsed between maximum foam volume development and a 50% volume reduction thereof, absent any external forces (other than gravity) acting upon the foam. Further, the foam is self-generating, produced by reaction of composition components, and requires no mechanical agitation or other forms of physical activation.

In a preferred embodiment of the present invention, either or both of the liquids include a thickening agent or system, present in an amount such that when the liquids form an admixture during delivery to a surface, the admixture results in a dense, stable foam sufficient for cleaning efficacy and stability. Thus, when the initially separated liquids are allowed to interact, the resulting liquid cleaning composition being delivered to the surface will have the cleaning or bleaching activity and stability appropriate for the cleaning or bleaching of that surface. The term "liquid" as used herein may include homogeneous liquids, solutions and suspensions. Preferably an aqueous liquid is contemplated; however, nonaqueous liquids are within the scope of the invention. The thickening agent or system should impart both a viscous component and an elastic component to the corresponding liquid; both components are most preferred for attaining the desired foam characteristics. Most preferably the thickening agent or system imparts a viscoelastic rheology to the corresponding liquid; however, thickened, nonelastic or slightly elastic systems can provide performance benefits and are thus within the scope of the present invention. The composition of the thickening system is less important than the attainment of at least one of the desired foam qualities as defined herein.

The present invention also relates to a container which maintains the two liquids separately until delivery and provides for such delivery, during which the pH-maintained admixture is formed and delivered to a surface to be treated. The container includes one compartment for the hypohalite containing liquid and another compartment for the peroxygen-containing liquid. Either or both of these two compartments may contain the thickening system or agent which, is present in an amount sufficient to thicken and for stability of the liquid, as described above. According to one aspect of the invention, the container may have separate delivery channels for the two liquid components for delivering the two liquids, whereupon the admixture is formed. These delivery channels may be constructed to provide for the contemporaneous delivery of the two liquids to the exterior of the container, whereupon the two liquids meet to form the admixture. Alternately, the separate delivery channels may communicate with an admixing space in which the two liquids form the admixture and from which the admixture is delivered to the exterior of the container. One example of such a container is that disclosed in U.S. Pat. No. 5,767,055 Choy et al., the disclosure of which is incorporated fully herein by reference.

The present invention further includes a method of cleaning drains which comprises the step of:

pouring into a drain at least one liquid which generates foam in situ, the foam characterized by a volume of at least 1.0 times the liquid volume; a density of at least about 0.1 g/ml, a half life of greater than about thirty minutes, and wherein the foam contains a cleaning-effective amount of a drain cleaning active. It is also within the scope of the present invention to provide a single solution capable of generating the foam upon release from its container, as by pouring into the drain.

Briefly, a first embodiment of the present invention comprises a stable cleaning composition comprising, in aqueous solution:

(a) a first liquid containing an oxidizing agent; and (b) a second liquid containing a gas generating agent; and wherein the oxidizing agent and gas generating agent react to generate a foam characterized by a density of at least about 0.1 g/ml, a volume of at least 1.0 times the liquid volume, a half life of greater than about thirty minutes, and wherein the foam contains a cleaning-effective amount of a drain cleaning active.

It should be noted that as used herein the term "cleaning" refers generally to a chemical, physical or enzymatic treatment resulting in the reduction or removal of unwanted material, and "cleaning composition" specifically includes drain openers, hard surface cleaners and bleaching compositions. The cleaning composition may consist of a variety of chemically, physically or enzymatically reactive active ingredients, including solvents, acids, bases, oxidants, reducing agents, enzymes, detergents and thioorganic compounds. Unless otherwise specified, all ingredient percentages are weight percentages.

For purposes of the discussion of the invention disclosed herein, a typical household sink drain comprises four sections: a vertical section, thence to a U-bend (or P-trap), thence to a 90-degree elbow, and finally a horizontal sewer arm.

A viscous rheology, preferably one with an elastic component, most preferably a viscoelastic rheology, may be imparted to a single liquid, or to both liquids of the composition, preferably by a binary system including a betaine or sulfobetaine having a $C_{14-18}$ alkyl group, or a $C_{10-18}$ alkylamino or alkylamido group, and an anionic organic counterion that is thought to promote elongated micelles. Such systems are more fully described in U.S. Pat. Nos. 4,900,467 and 5,389,157 to Smith, and assigned to the assignee of the invention herein, the disclosures of which are incorporated herein by reference. Preferably the betaine is a $C_{14-18}$ alkyl betaine and the counterion is a $C_{2-6}$ alkyl carboxylate, aryl carboxylate, $C_{2-10}$ alkyl sulfonate, aryl sulfonate, sulfated aryl or $C_{2-10}$ alkyl alcohols, and mixtures thereof. Most preferably the counterion is an aryl sulfonate, e.g. sodium xylene sulfonate. The counterion may include substituents which are chemically stable with the active cleaning compound. Preferably, the substituents are alkyl or alkoxy groups of 1–4 carbons, halogens and nitro groups, all of which are stable with most actives, including hypochlorite. The viscosity of the formulations of the present invention can range from slightly greater than that of water, to several thousand centipoise (cP). Preferred from a consumer standpoint is a viscosity range of about 20 cP to 2500 cP. A preferred viscosity range for the first (oxidant-containing) liquid is about 100 to 2500 cP, more preferred is 500 to 2200 cP. A preferred viscosity for the second (gas generating) liquid is about 50–1000 cP, more preferred is 100–800 cP.

A second embodiment of the present invention is a composition and method for cleaning drains, the composition comprising separately maintained aqueous solutions of:

(a) a first liquid comprising a hypohalite compound; and;

(b) a second liquid comprising a peroxygen compound; and wherein at least one of liquids (a) or (b) is viscous.

The liquids (a) and (b) are maintained separately during storage, and combined concurrently with, or immediately prior to use. Preferably, the liquids (a) and (b) are maintained in a dual chamber or compartment bottle, and poured simultaneously into the drain wherein the foam generation occurs. The resulting foam is stable and dense, and contains a high percentage of cleaning active, especially hypohalite, which coats the vertical and upper P-trap portions of a drain. The rheology of each composition provides a favorable rate of foam generation and residence time, resulting in excellent cleaning efficacy. The rate of foam generation should be relatively slow, preferably less than about 50 ml/sec and the foam should remain stable for an extended period of time. The rheology also facilitates filling of the container, e.g., during manufacturing, and affords consumer-acceptable pouring properties during dispensing and use. The preferred viscoelastic rheology may be imparted by a thickener, preferably a surfactant thickener. While only one solution may be viscoelastic, it is preferred that both are viscoelastic, and the same or different thickening agents or systems can be used. Most preferably viscoelasticity is imparted to both liquids (a) and (b) by the same thickening agent or system.

It is therefore an advantage of the present invention that the composition is chemically and phase-stable, and retains such stability at both high and low temperatures.

It is another advantage of the present invention that, when formulated as a drain cleaner the foaming composition provides an elevated contact time, improving the efficacy of the cleaner.

It is another advantage of the present invention that the improved efficacy resulting from the increased contact time allows for safer drain cleaning formulations.

It is yet another advantage of the present invention that the composition generates a stable, active-containing foam in-situ.

It is a further advantage of the composition of the present invention that the rheology of the composition facilitates container filling, and dispensing.

These and other objects and advantages of the present invention will no doubt become apparent to those skilled in the art after reading the following Detailed Description of the Preferred Embodiments.

DETAILED DESCRIPTION OF THE PREFERRED EMBODIMENTS

Oxidizing Agent

Figure 1:
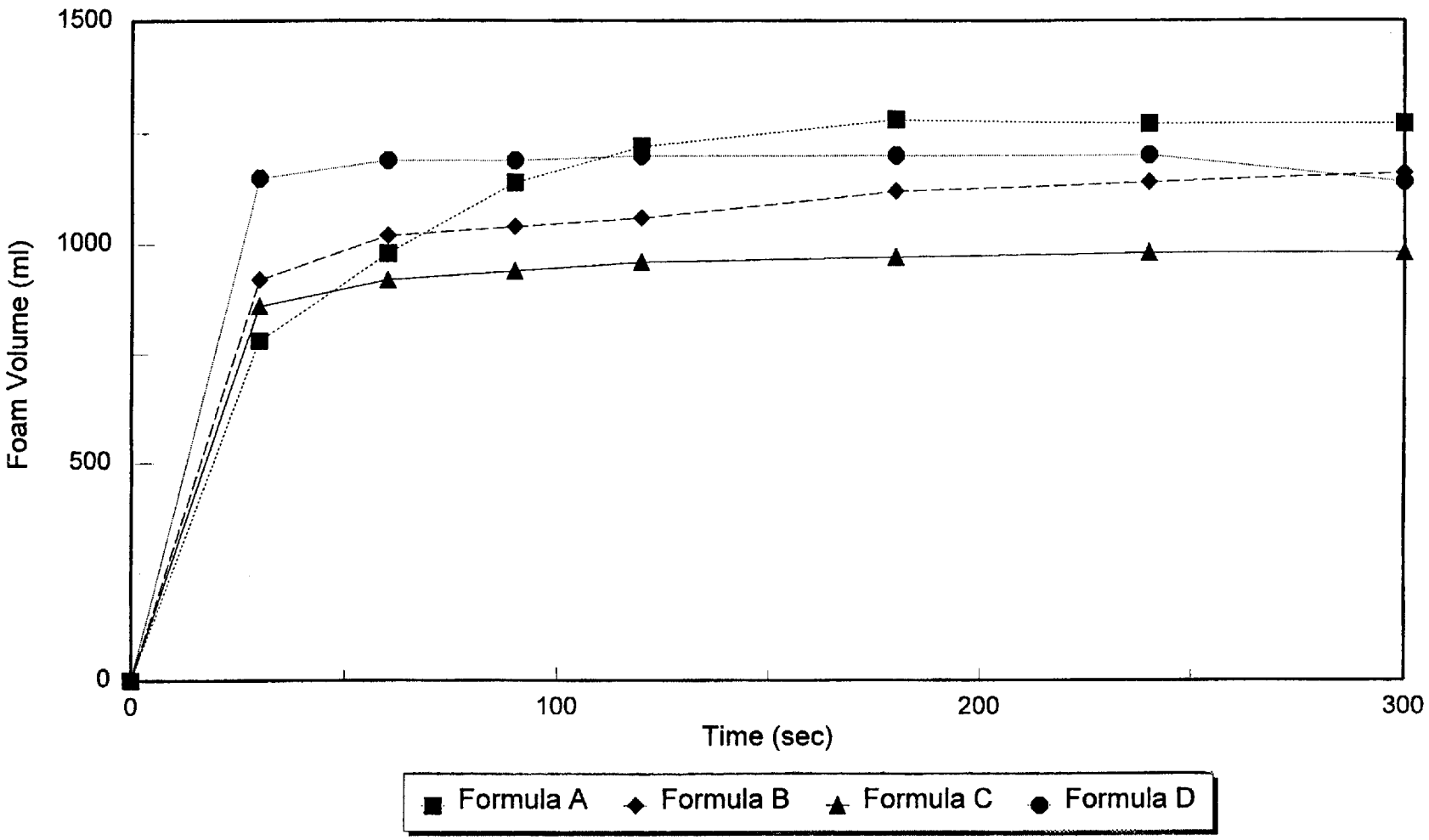
FIG. 1 is a graph comparing foam generation rates of a composition of the present invention to the other compositions.

The oxidizing agent, or oxidant, may preferably be selected from various hypohalite-producing species, for example, halogen bleaches selected from the group consisting of the alkali metal and alkaline earth salts of hypohalite, haloamines, haloimines, haloimides and haloamides. All of these are believed to produce hypohalous bleaching species in situ. Preferably, the first oxidizing agent is a hypohalite or a hypohalite generator capable of generating hypohalous bleaching species. As used herein, the term "hypohalite" is used to describe both a hypohalite or a hypohalite generator, unless otherwise indicated. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromo-cyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo and dichloro dimethyl-hydantoin, chlorobromodimethyl hydantoin, N-chlorosulfamide (haloamide) and chloramine (haloamine). Particularly preferred in this invention is sodium hypochlorite having the chemical formula NaOCl, in an amount ranging from about 0.1 weight percent to about 15 weight percent of the first liquid, more preferably about 0.1 to 10 weight percent, and most preferably about 1 to 8 weight percent. The oxidizing agent may be present in an stoichiometric amount to the gas generating agent for the generation of foam. If so, it is preferred that a separate cleaning active be included with either or both the first and second liquids. More preferred is that the oxidizing agent be present in a stoichiometric excess, to both generate foam and provide cleaning and drain opening activity.

Gas Generating Agent

The gas generating agent is a compound which can react with the oxidizing agent to generate a gas and is preferably a peroxide or peroxide-generator, such as hydrogen peroxide, or a peracid or persalt, including both organic and inorganic peracids and persalts, such as peracetic acid and monoperoxysulfate, respectively. A number of peroxides, peracids and persalts are disclosed in U.S. Pat. No. 4,964,870, to Fong, et al, the disclosure of which is incorporated herein in its entirety by reference. Hydrogen peroxide is normally supplied as a liquid, although other hydrogen peroxide sources may also function satisfactorily. For example, perborate and percarbonate also supply $H_2O_2$ in solution. The gas generating agent is present in an amount of about 0.01 to 8 weight percent of the second liquid, preferably about 0.1 to 5 weight percent, most preferably about 0.2 to 3 weight percent.

Where peroxide is the gas generating agent and a hypohalite is the oxidizing agent, a preferred weight ratio (to provide a stoichiometric excess) of hypohalite to peroxide is about 20:1 to 3:1, more preferred is about 15:1 to 7:1, and most preferred is 12:1 to 5.1. A preferred mole ratio (to provide a stoichiometric excess) of hypohalite to peroxide is about 10:1 to 1:1, more preferred is about 7:1 to 5:4, and most preferred is about 5:1 to 2:1.

Electrolyte/Buffer

An electrolyte/buffer may be included with either the first or second liquids and preferably is included in the first, oxidant-containing liquid in a buffering-effective amount.

According to the present invention, suitable electrolytes/buffers may be selected from the group consisting of a carbonate, a phosphate, a pyrophosphate, an amino carboxylate, a polycarboxylate, a polyacrylate, a phosphonate, an amino phosphonate, a polyphosphonate, a salt thereof, and a mixture thereof. The electrolyte/buffer is present in an amount ranging from 0 to about 5 weight percent of the first liquid, preferably from about 0.01 to about 4 weight percent of the first liquid.

pH-Adjusting Agents

A pH-adjusting agent may be present in either one or both of the two liquids, i.e., with the oxidant and/or gas generating agent. According to the present invention, the pH-adjusting agent maintains the pH of the liquid such that the active agent therein is stable and efficacious. The pH adjusting agent can be either alkaline or acidic in solution, and correspondingly serve to adjust and/or maintain either solution to an alkaline or acidic pH. In the present invention, each solution is maintained at a pH which is appropriate for the activity and stability of the oxidizing or gas generating agent and/or cleaning active therein. For an alkaline oxidizing agent, such as a hypohalite, the solution pH is alkaline. When the gas generating agent is peroxygen, the pH is acidic. The pH-adjusting agent may be present in a pH adjusting effective amount, such as between about 0 and about 10 weight percent of one of the liquids.

Suitable acidic pH adjusting agents include: organic acids, especially carboxylic acids such as citric, glycolic, or acetic acids, weak inorganic acids such as boric acid or sodium bisulfate, and dilute solutions of strong inorganic acids such as sulfuric acid, hydrochloric acid, pyrophosphates, triphosphates, tetraphosphates, silicates, metasilicates, polysilicates and borates and mixture of the foregoing. When the gas-generating agent is peroxide, a preferred acidic pH adjusting agent is sulfuric acid. For a peroxygen-containing liquid, especially hydrogen peroxide, it is preferred the pH be maintained below about 7, more preferably between 3 and 6 to maintain stability and efficacy of the peroxygen compound. An acidic pH-adjusting agent is present in an amount of from 0 to 5 weight percent to the second liquid, preferably from 0.001 to 2 weight percent.

Preferred alkaline pH adjusting agents include: carbonates, bicarbonates, hydroxides, hydroxide generators and mixtures of same. When the oxidant is a hypohalite, a preferred alkaline pH-adjusting agent is an alkali metal hydroxide, especially sodium hydroxide. For example, when a hypohalite oxidizing agent is used, the pH of the solution is preferably maintained at above about 10, preferably above about 10.5, and more preferably above about 11. An solution pH of above about 11 is believed to be sufficient for both the cleaning efficacy and the stability of hypohalite. More particularly, this solution pH is believed to be sufficient to protect against the autocatalytic destruction of the hypohalite that might otherwise occur when the solution is formed. An alkaline pH-adjusting agent is present in an amount of from 0 to 20 weight percent, to the first liquid, preferably from 0.1 to 15 weight percent.

Thickener

Either or both of the first oxidant and second gas-generating solutions or liquids is thickened, preferably with a surfactant thickener. Suitable thickeners are as described in previously referenced Smith patents. Other suitable systems may be found in the disclosures of U.S. Pat. No. 5,055,219 and U.S. Pat. No. 5,011,538 to Smith; U.S. Pat. Nos. 5,462,689 and 5,728,665 to Choy, et al., all commonly owned with the invention herein, and the disclosures of each of which are incorporated fully herein by reference. Additional thickeners such as polymers and gums are suitable as long as the desired foam characteristics and/or rheology is attained. Most preferred is a binary surfactant viscoelastic thickener comprising a betaine and anionic counterion.

Betaine

Operative betaines include the $C_{14-18}$ alkyl betaines and $C_{14-18}$ alkyl sulfobetaines. Especially preferred is a cetyl dimethyl betaine (CEDB) such as Amphosol CDB (a trademarked product of the Stepan Company), which is about 95% or greater $C_{16}$, less than 5% $C_{12/14}$ and less than 1% $C_{18}$. It is noted that when referring to carbon chain lengths of the betaine or any other compound herein, the commercial, polydisperse forms are contemplated (but not required). Thus, a given chain length within the preferred $C_{14-18}$ range will be predominately, but not exclusively, the specified length. As used herein in reference to the betaine or sulfobetaine, the term "alkyl" includes both saturated and unsaturated groups. Fully saturated alkyl groups are preferred in the presence of hypochlorite. $C_{10-18}$ alkylamido and alkylamino betaines, and sulfobetaines having $C_{14-18}$ alkyl, or $C_{10-18}$ alkylamino or alkylamido groups, are also suitable for use in the compositions of the present invention.

The betaine is added at levels, which, when combined with the counterion, are thickening effective. Generally about 0.1 to 10.0 weight percent of the betaine is utilized per each of the first and/or second liquid, preferred is to use about 0.1 to 5.0% betaine, and most preferred is about 0.15–2.0 percent betaine.

Counterion

The counterion is an anionic organic counterion selected from the group consisting of $C_{2-6}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, and preferred are those having two to eight carbon atoms. The counterions may be added in acid form and converted to the anionic form in situ, or may be added in anionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. In some circumstances the cleaning active itself may be within the class of thickening-effective counterions. For example, some carboxylic acid cleaning actives may be present in both the acid and conjugate base forms, the latter which could serve as the counterion. The $C_{2-6}$ alkyl carboxylates may act in this manner. The counterion is added in an amount sufficient to thicken and result in a viscoelastic rheology, and preferably between about 0.01 to 10 weight percent. A preferred mole ratio of betaine to counterion depends on the chain length and concentration of the betaine, type of counterion, and the ionic strength of the solution, as well as whether the primary object of the composition is phase stability or viscosity. Using CEDB and sodium xylene sulfonate (SXS), a preferred mole ratio is about 10:1 to 1:3, and more preferred is about 2:1 to 1:2. A preferred weight ratio of CEDB to SXS is about 15:1 to 1:2, and more preferred is 3:1 to 1:1.

The viscoelasticity of the thickener advantageously imparts unusual flow properties to the cleaning composition. Elasticity causes the stream to break apart and snap back into the bottle at the end of pouring instead of forming syrupy streamers. Further, elastic fluids appear more viscous than their viscosity indicates. The viscoelastic properties of a fluid can be measured with instruments such as a Bohlin VOR rheometer. A frequency sweep with a Bohlin rheometer can produce oscillation data which, when applied to a Maxwell model, result in parameters such as relaxation time (Tau) and static shear modulus (G0). The relaxation times of the formulations of the present invention are between about 0.1–50 seconds, preferably between about 0.345 seconds more preferably between about 1–30 seconds and most preferably between about 5–25 seconds. The ratio of relaxation time to static shear modulus (Tau/G0), previously defined as relative elasticity by Smith, should be between about 1–300 sec/Pascal (Pa,) preferred between about 5–150 sec/Pa., and more preferred between about 10–100 sec/Pa. While the thickeners described herein are effective to develop viscoelasticity over a range of solution ionic strengths, the ionic strength does influence rheology to some extent. Accordingly, unless otherwise stated, the relaxation times relative elasticities and viscosity values used herein are calculated for a first (hypohalite-containing) liquid having an ionic strength of about 2.4 molal and a second (peroxygen-containing) liquid having an ionic strength of about 3.4 molal. Examples of such liquids are shown in Table III as formulas (b) and (e), respectively.

Adjuncts

A number of classes of adjunct compounds are known and are compatible with the first and second liquids and components thereof. One such class are adjunct cleaning actives, which interact with their intended target materials either by chemical or enzymatic reaction or by physical interactions, hereinafter collectively referred to as reactions. It is noted that either the oxidant or gas generating agent can function as the cleaning active, particularly when one is present in a stoichiometric excess over the other. Preferably, the oxidant is present in a stoichiometric excess over the gas generating agent; however, a cleaning active may be additionally included. Useful active compounds thus include acids, bases, oxidants, reductants, solvents, enzymes, thioorganic compounds, surfactants (detergents) and mixtures thereof. Examples of enzymes include lipases, keratinases, proteases, amylases, and cellulases. Useful solvents include saturated hydrocarbons, ketones, carboxylic acid esters, terpenes, glycol ethers, and the like. Thioorganic compounds such as s odium thioglycolate can be included to help break down hair and other proteins. Various nonionic, anionic, cationic or amphoteric surfactants can be included, as known in the art, for their detergent properties. Examples include taurates, sarcosinates and phosphate esters. Other noncleaning active adjuncts as known in the art, such as corrosion inhibitors, dyes and fragrances, may also be included.

While compositions having a viscous rheology, especially a viscoelastic rheology, provide a benefit when applied to drains having porous or partial clogs, the fall benefit is obtained when the composition is thickened and possesses a density greater than water. This density may be attained without the need for a densifying material, however, when necessary to increase the density, a salt such as sodium chloride is preferred and may be added at levels of 0 to about 25 weight percent to the liquid, preferably 12–25 weight percent. It is preferred that the second liquid, i.e., that including the gas generating agent, be denser than the first liquid, i.e., that containing the oxidant. By so doing, the gas generating agent will fill the lowest portion of the P-trap, and the first liquid, containing the oxidant, will "cap" the second liquid on either side of the P-trap, i.e., in the 90-degree elbow and in the vertical pipe. Gas generation thus occurs principally at the interface of the two liquids, and within the lowest portions of the P-trap, permitting the foam to expand upwards to contact fully the clogged portions of the drain, especially the vertical pipe. The expanding gas passes through the oxidant, entraining it into the foam and distributing it throughout the pipe. The rate of foam generation additionally is slowed by the rheology of the first and second liquids, so that the foam is long lasting and a greater percentage of actives is delivered. The rheology of the oxidant-containing first liquid specifically controls foam generation in at least two respects. First the viscosity and elasticity of the first solution acts to cap the denser second solution, especially on the vertical side of the P-trap, providing a slow, continuous foaming reaction. Second, the rheology of the first liquid which remains in the 90-degree elbow of the pipe acts to physically plug the pipe, preventing the liquids and/or foam from being siphoned off into the sewer arm of the drain. For the foregoing reasons, it is most preferred the first liquid have a specific gravity of about 1.10 or greater, and the second liquid have a specific gravity greater than that of the first, more preferably about 1.12 or greater. A preferred ratio of specific gravities of second to first liquids is about 1.01:1 to 1.5:1.

FIG. 1 shows four foam generation/decomposition curves for four different thickening systems in conjunction with the preferred hypochlorite/peroxide oxygen/gas generating system of the present invention. Formula A (curve A) utilizes the preferred betaine plus sodium xylene sulfonate thickener in both the hypochlorite and peroxide solutions. The composition used to generate curve A, is as shown in Table III examples (b) and (e) combined. Curve/formula B utilizes the preferred betaine plus sodium xylene sulfonate in the hypochlorite solution Table III example (b) and the ethoxylated alcohol thickener of Table III (f) in the peroxide solution. The Formula C (curve C) utilizes the preferred thickening system with the peroxide (Table III (e)), and the amine oxide/soap (Table III (c)) with the hypochlorite. Finally, curve D utilizes the amine oxide/soap thickener (Table III(c)) for the hypochlorite and the ethoxylated alcohol thickener of Table III (f) in the peroxide solution. Note that all thickeners used to generate the curves of FIG. 1 are within the scope of the present invention.

The following table (Table I) illustrates the important Theological characteristics of the hypochlorite and peroxide components for each formula shown in FIG. 1.

TABLE I

| Formula | | | Viscosity (cP) | Relative Elasticity (sec/Pa) | Relaxation Time (sec.) |
|---|---|---|---|---|---|
| A | hypochlorite | (b) | 1,232 | 26 | 32.1 |
| | peroxide | (e) | 456 | 50.3 | 33.6 |
| B | hypochlorite | (b) | 1,232 | 26 | 32.1 |
| | peroxide | (f) | 2,112 | 0.002 | 0.13 |
| C | hypochlorite | (c) | 1,880 | 0.02 | 0.36 |
| | peroxide | (e) | 456 | 50.3 | 33.6 |
| D | hypochlorite | (c) | 1,880 | 0.02 | 0.36 |
| | peroxide | (f) | 2,112 | 0.002 | 0.13 |

In the Figure, the foam volume was measured by pouring about 500 ml of a composition according to Example 10, Table V, into a 2 L graduated cylinder. Viscosities were measured on a Brookfield Rheometer, model DV–II+, with a teflon®-coated number 2 spindle at 5 rpm after two minutes. Tau, G0 and relaxation times were measured on a Bohlin VOR at 25° C. in the oscillatory mode. Foam volume was visually measured at various intervals. An initial phase (or phase I) of foam generation begins when the first and second liquids are combined, for example in a drain or on a surface, at time zero ($t_0$). The initial phase generally lasts about 60 seconds, preferably about 50 seconds, from $t_0$. A secondary phase (or phase II) begins at the end of the initial phase and extends from about 20 to 500 seconds, preferably about 30 to 300 seconds, after the initial phase ends. Following the end of the secondary phase, a tertiary phase (or phase III) lasts for another 80 to 3600 seconds, preferably 90 to 1000 seconds.

At the completion of the tertiary phase, the foam is essentially dissipated; therefore, an exact end point is not critical. Further, the duration of both the secondary phase and the tertiary phase is less important than the duration of the initial phase, as the initial phase defines the initial foam generation kinetics which are important in treatment efficacy.

At greater than about 60 ml/second generation rate, the foam tends to siphon into the sewer arm resulting in minimal contact time. At less than about 20 ml/seconds there will be insufficient foam "moment" to attack the clog. The first two phases define foam development: an initial rapid increase (phase I) and a second, slow increase (phase II). The tertiary phase defines a very slow increase to a slow decrease. It is preferred that phase I occur at about 10–50 ml/sec, more preferably 15–45 ml/sec, and most preferably 25–40 ml/sec. Phase II preferably occurs at 0.01–6 ml/sec, more preferably at 0.1–5 ml/sec, and most preferably 1–3.5 ml/sec. In phase III, the rate of foam development should be about 0.001 ml/sec to negative 0.2 ml/sec.

It can be seen from FIG. 1, that curve A displays the most preferred performance, showing a rapid initial phase; a slower second phase; and a final slow degradation phase. The remaining curves: B, C and D, while all displaying performance within the scope of the present invention, do not employ the most preferred thickening system with both the hypochlorite and the peroxide components, therefore do not yield the same curve.

Table II below gives preferred viscosity, relative elasticity and relaxation time ranges for each of the preferred oxidizing agent and gas generating agent.

TABLE II

| | Oxidizing Agent | Gas Generating Agent |
|---|---|---|
| Viscosity (cPs.) | 100–2500 | 50–2500 |
| Relative elasticity (Tau/G0) | 1–300 | 1–300 |
| Relaxation time (sec.) | >0.3 | >0.1 |

The aforementioned parameters of viscosity, relaxation time and relative elasticity influence the effective performance of compositions of the present invention, and it most preferred that each of the first and second liquids possess all three of the desired properties. However, there are a number of variables which influence rheology, thus it is understood that the rheological properties herein are not necessarily exclusive in defining a composition within the scope of the present invention, which is preferably defined by the functional foam characteristics and cleaning efficacy. Compositions are within the scope of the present invention if they include one liquid which has at least one of the rheological properties as long as foam generation and cleaning efficacy is attained. Preferably one liquid has at least one of the properties and the remaining liquid possesses at least two such rheological properties. More preferably, one of the liquids has at least two, and the other three, rheological properties.

A third embodiment of the present invention comprises a drain opening formulation and method of use. The formulation includes a first liquid comprising:

(i) a hypohalite;

(ii) a corrosion inhibitor;

(iii) a buffer;

(iv) a pH adjusting agent, and (v) a thickener and a second liquid comprising:

(i) a peroxide;

(ii) a pH adjusting agent;

(iii) a densifying agent;

(iv) a thickener and wherein the first and second liquids are separately maintained, for example, in separate chambers of a dual chambered bottle, and admix upon, concurrently with or shortly after dispensing into a drain. A most preferred method of opening drains involves pouring a first and a second liquid, simultaneously from a dual chamber bottle, into a drain to be cleaned, and allowing a period of time for the active-entrained foam to decompose the obstruction.

A preferred example of a drain cleaning formulation includes a first composition comprising:

(i) a $C_{14-18}$ s alkyl betaine or sulfobetaine;

(ii) an anionic organic counterion;

(iii) an alkali metal hydroxide;

(iv) an alkali metal silicate;

(v) an alkali metal carbonate; and (vi) an alkali metal hypochlorite and a second composition comprising (i) a $C_{14-18}$ alkyl betaine or sulfobetaine;

(ii) an anionic organic counterion;

(iii) hydrogen peroxide;

(iv) sulfuric acid; and (v) sodium chloride.

Components (i) and (ii) comprise the viscoelastic thickener and are as described previously. The alkali metal hydroxide is preferably potassium or sodium hydroxide, and is present in an amount of between about 0.5 and 20% percent. The preferred alkali metal silicate is one having the formula $M_2O(SiO)_n$ where M is an alkali metal and n is between 1 and 4. Preferably M is sodium and n is 3.2. The alkali metal silicate is present in an amount of about 0 to 5 percent. The preferred alkali metal carbonate is sodium carbonate, at levels of between about 0 and 5 percent. About 1 to 15 percent hypochlorite is present, preferably about 4 to 8.0 percent.

Generally, the preferred betaine for use with hypochlorite is an alkyl dimethyl betaine or sulfobetaine compound having a 12 to 18 carbon alkyl group, and most preferably the betaine is CEDB. The alkylamido betaines and alkylamino betaines are not preferred in the presence of hypochlorite. Also when hypochlorite is present, the composition is most stable with no more than about 1.0 weight percent betaine, although up to about 10 weight percent betaine can be used. Substituted benzene sulfonic acids are preferred as the counterion with xylene sulfonic acid being most preferred.

While the hypochlorite/perioxide foam generating system is preferred, other systems can be used to generate foam as long as the desired foam characteristics are attained. Most preferably such foam characteristics are attained when one or both solutions are viscous, and more preferably when one or both solutions are viscoelastic, having a Tau/G0 of 1–300 and relaxation time of at least about 0.3 sec., preferably at least about 5 sec.

FORMULATION EXAMPLES

Formulation Example 1:

| Liquid 1-Oxidant | Weight Percent | Liquid 2-Gas Generator | Weight Percent |
|---|---|---|---|
| Sodium hypochlorite | 1–15 | Hydrogen peroxide | 0.01–5.0 |
| Sodium hydroxide | 0.1–20 | Sodium chloride | 0–30 |
| Sodium carbonate | 0–5 | Sulfuric acid | 0.001–5 |
| Sodium silicate | 0–5 | Betaine | 0.1–10 |
| betaine | 0.1–10 | SXS | 0.1–10 |
| SXS | 0.1–10 | | |

EXPERIMENTAL

TABLE III

| Example | Formula | Foam Generation Rate (ml/sec) Phase I | Phase II | Phase III |
|---|---|---|---|---|
| 1 | b + e | 27 | 3.0516 | −0.0759 |
| 2 | b + e | 26 | 3.2432 | −0.0584 |
| 3 | b + f | 31 | 0.7841 | −0.0574 |
| 4 | c + e | 29 | 0.0177 | n/a |
| 5 | c + f | 38 | 0.1765 | −0.651 |

(b) = 5.80% sodium hypochlorite, 1.85% sodium hydroxide, 0.0578% sodium carbonate, 0.1128% sodium silicate, 0.78% betaine, 0.39% SXS.
(c) = 5.57% sodium hypochlorite, 2.50% sodium hydroxide, 1.10% sodium silicate, 1.00% $C_{14}$ amine oxide, 0.18% $C_{16}$ amine oxide, 0.58% $C_{10}$ fatty acid soap, 0.34% $C_{12}$ fatty acid soap.
(e) = 0.50% hydrogen peroxide, 20% sodium chloride, 0.015% sulfuric acid, 0.374% betaine, 0.262% SXS.
(f) = 0.51% hydrogen peroxide, 10% sodium chloride, 10% ethoxylated alcohol sulfate (sodium salt).

Table III above shows the midpoint foam generation rate for phases I and II, and the midpoint for the foam degradation rate, for 5 different formulations of hypochlorite/peroxide, having the thickening systems noted. Examples 1 and 2 illustrate performance of the most preferred embodiments, wherein both components are thickened with the preferred system. Examples 3 and 4 include one binary component thickened with the most preferred thickener, and the other binary component thickened with a less preferred thickener, as indicated in the Table. Example 5 is an amine oxide and ethoxylated alcohol sulfate thickened binary system, which is still within the scope of the present invention.

Table IV below shows the chemical stability at various storage temperatures of both the bleach and peroxide compositions of the present invention. The numbers reported are percentage active remaining. Actives stability is very good, especially for the peroxide composition which contains 20% NaCl. High ionic strength tends to destablize peroxides, thus the peroxide stability is surprising, and thought to be due to the thickening system acting to immobilize the ions (as well as any residual metals) in the composition. The Bleach Composition of Table IV comprises the following weight percent of ingredients: 5.80% sodium hypochlorite, 1.85% sodium hydroxide, 0.0578% sodium carbonate, 0.1128% sodium silicate, 0.78% betaine, 0.39% SXS. The Peroxide Composition comprises 0.51% hydrogen peroxide, 20% sodium chloride, 0.015% sulfuric acid, 0.3742% betaine, and 0.2616% SXS.

TABLE IV

| Time (weeks) | Percent Actives Remaining: Bleach Composition 2° C. | 21° C. | 38° C. | Peroxide Composition 2° C. | 21° C. | 38° C. |
|---|---|---|---|---|---|---|
| 4 | 99 | 95 | 66 | 99 | 99 | 90 |
| 8 | 97 | 38 | 48 | 100 | 97 | 77 |
| 12 | 94 | 84 | 38 | 100 | 98 | 74 |
| 16 | 93 | 79 | 31 | 100 | 95 | 61 |
| 26 | 87 | 72 | 23 | 100 | 88 | 31 |

Table V shows the effect of thickener type and rheology on clog remover performance. While thickened formulas alone may provide benefits, it has been found that the combination of thick, viscoelastic solutions of the present invention provide the greatest clog remover performance. All tests were performed on typical household sink drains comprising of 3.8 cm diameter pipe with a vertical section, a U-bend or P-trap, a 90° elbow and a horizontal sewer arm. Foam volume and bleach delivery were measured 5 minutes after pouring. Examples 1 and 2 show that non-thickened formulas do not produce enough foam in the drain pipe. Examples 3 and 4 show results when at least one formula is viscoelastic. The next examples show the effects of a combination of a simple thickened formula with a thick, viscoelastic solution. Examples 5 and 7 utilize a hydrogen peroxide formula thickened with an alternative thickener, e.g., an ethoxylated alcohol sulfate. Examples 6 and 7 illustrate the use of another thickener, e.g., $C_{14-16}$ amine oxides, a bleach stable thickening surfactant commonly known to those skilled in the art. Examples 8–10 illustrate the beneficial performance of the preferred embodiments of the present invention.

TABLE V

Surfactant Effect on Drain Opener Performance

| Example | Hypochlorite Composition: % Active | Additional Ingredients (wt %) | Peroxide Composition: % Active | Additional Ingredients (wt %) | Vertical Pipe Foam Volume (ml) | Bleach Delivery (wt %) |
|---|---|---|---|---|---|---|
| 1 | 5.80 | † | 0.45 | ‡ | 0* | 0 |
| 2 | 5.56 | # | 0.49 | $ | 203 | 1.37 |
| 3 | 5.80 | (a) | 0.51 | $ | 376 | 0.15 |
| 4 | 5.66 | # | 0.50 | (e) | 188 | 2 |
| 5 | 5.80 | (b) | 0.51 | (f) | 304 | 0.07 |
| 6 | 5.57 | (c) | 0.51 | (g) | 232 | 1.46 |
| 7 | 5.57 | (c) | 0.48 | (f) | 246 | 0.88 |
| 8 | 5.43 | (d) | 0.42 | (h) | 333 | 1.06 |

TABLE V-continued

Surfactant Effect on Drain Opener Performance

| | Hypochlorite Composition | | Peroxide Composition | | | |
|---|---|---|---|---|---|---|
| Example | % Active | Additional Ingredients (wt %) | % Active | Additional Ingredients (wt %) | Vertical Pipe Foam Volume (ml) | Bleach Delivery (wt %) |
| 9 | 5.80 | (a) | 0.51 | (g) | 333 | 1.21 |
| 10 | 5.80 | (b) | 0.50 | (e) | 362 | 1.13 |

*foam was generated but immediateiy siphoned off
(a) = 5.80% sodium hypochlorite, 1.85% sodium hydroxide, 0.0578% sodium carbonate, 0.1128% sodium silicate, 0.78% betaine, 0.35% SXS.
(b) = 5.80% sodium hypochlorite, 1.85% sodium hydroxide, 0.0578% sodium carbonate, 0.1128% sodium silicate, 0.78% betaine, 0.39% SXS.
(c) = 5.57% sodium hypochlorite, 2.50% sodium hydroxide, 1.10% sodium silicate, 1.00% $C_{14}$ amine oxide, 0.18% $C_{16}$ amine oxide, 0.58% $C_{10}$ fatty acid soap, 0.34% $C_{12}$ fatty acid soap.
(d) = 5.43% sodium hypochlorite, 1.85% sodium hydroxide, 0.0578% sodium carbonate, 0.1128% sodium silicate, 0.77% betaine, 0.35% SXS.
(e) = 0.50% hydrogen peroxide, 20% sodium chloride, 0.015% sulfuric acid, 0.374% betaine, 0.262% SXS.
(f) = 0.51% hydrogen peroxide, 10% sodium chloride, 10% ethoxylated alcohol sulfate (sodium salt).
(g) = 0.51% hydrogen peroxide, 20% sodium chloride, 0.015% sulfuric acid, 0.374% betaine, 0.262% SXS.
(h) = 0.42% hydrogen peroxide, 20% sodium chloride, 0.015% sulfuric acid, 0.4675% betaine, 0.3275% SXS.
†= 5.80% sodium hypochlorite, 1.85% sodium hydroxide, 0.0578% sodium carbonate, 0.1128% sodium silicate.
‡= 0.50% hydrogen peroxide, 20% sodium chloride, 0.015% sulfuric acid.
# = non-thickened bleach containing surfactant: 5.47% sodium hypochlorite, 1.82% sodium hydroxide, 0.0569% sodium carbonate, 0.1111% sodium silicate, 0.7681% betaine, 0.9946% SXS.
$ = non-thickened peroxide containing surfactant: 0.48% hydrogen peroxide, 19.7% sodium chloride, 0.0148% sulfuric acid, 0.368% betaine, 0.9239% SXS.

Other foam properties of interest include foam density and stability. A dense, stable foam will allow longer contact time between cleaning actives and organic clog materials. Foam stability is defined as the foam's resistance to a force tending to collapse or displace the foam. For the present invention, foam stability is determined by measuring the rate of travel of a standard object through a column of foam. The object used in this experiment is a black, phenolic screw cap found on typical laboratory sample jars. The cap has a 5 cm diameter, a 1.2 cm lip, and weighs 11 grams. The inverted cap is placed on top of the column of foam and the time to completely travel through the foam is measured. A foam displacement rate is calculated by dividing the height of the foam column by the total time required to travel through it. A preferred foam displacement rate is less than about 10 cm/min; more preferred is less than about 6 cm/min. The ratio of foam displacement rate to density can also be determined for combinations of thickened gas generating and oxidizing agents. A preferred ratio is about 50:1 to 1:1, more preferred is about 30:1 to 10:1. Table VI lists these foam properties.

Table VII shows performance of the present invention on hair restrictions in drains. For this test, 4 grams of human hair was mixed with about 2 grams of a 10% soap solution, and the resulting hair ball was suspended in the drain at the approximate location of the stopper rod mechanism. The time for 3.785 liters of water to drain from the sink was recorded as the initial flowrate. Non-thickened and thickened commercially available clog removers were used in the tests according to label instructions. Tests were also conducted with unthickened oxidizing and gas generating composition, along with compositions of the present invention. About 500 ml of each of the drain opening compositions was poured into the drain. The time for 3.785 liters of water to drain from the sink was again measured and recorded as the final flowrate. After the completion of each test the remaining hair was rinsed, dried overnight at 38° C., and weighed. The present invention dissolved an average of 71.8% of the hair while the non-thickened and thickened commercial products dissolved an average of only 20.1% and 52.9%, respectively. The unthickened combination of oxidizing and gas generating liquids dissolved an average of only 13.8% of hair. Final flowrates for drains treated with either thickened commercial product or the present invention are comparable to flows found in sinks with unobstructed drains. The unthickened compositions did not result in significantly improved flowrates.

TABLE VII

Performance On Hair Clogs

| Example | Product | % NaOCl | Initial hair amt. (g) | Final hair amt. (g) | % hair dissolved | Avg. % hair dissolved | Initial flow rate (l/min) | Final flow rate (l/min) |
|---|---|---|---|---|---|---|---|---|
| 1 | (a) | 5.59 | 4 | 3.1 | 22.5 | 20.1 | 3.5 | 7.3 |
| 2 | (a) | 5.66 | 4 | 3.3 | 17.8 | | 2.4 | 3.7 |
| 3 | (b) | 5.49 | 4.1 | 2 | 51.2 | 52.9 | 3 | 23.5 |
| 4 | (b) | 5.53 | 4 | 1.8 | 54.6 | | 3.6 | 26.5 |
| 5 | (c) | 5.66 | 4 | 3.2 | 19.8 | 13.8 | 3 | 3.8 |

TABLE VII-continued

Performance On Hair Clogs

| Example | Product | % NaOCl | Initial hair amt. (g) | Final hair amt. (g) | % hair dissolved | Avg. % hair dissolved | Initial flow rate (l/min) | Final flow rate (l/min) |
|---|---|---|---|---|---|---|---|---|
| 6 | (c) | 5.66 | 4 | 3.7 | 7.8 | | 3.8 | 3.8 |
| 7 | (d) | 5.57 | 4 | 1.1 | 72.5 | 71.8 | 4.1 | 19.7 |
| 8 | (d) | 5.57 | 4 | 1.2 | 70.3 | | 4.2 | 18.9 |
| 9 | (d) | 5.57 | 4 | 1.1 | 72.8 | | 4.2 | 22.7 |

(a) = an unthickened, commercially available liquid drain opener
(b) = a thickened, commercially available liquid drain opener
(c) = an unthickened combination of oxidizing and gas generating agents, made according to Example 2 of Table V
(d) = a formulation of the present invention, made according to Example 10 of Table V Examples 7–9 which are formulation of the present invention, show a much greater average hair dissolved than any of the other examples. This improvement is thought to be due to the increased contact time afforded by the present invention. It can be seen that the present invention also yield a better initial flow rate, and the final flowrates were better than all but product (b).

A most preferred method of opening drains involves pouring a first and a second liquid, as illustrated by Formulation Example 1, simultaneously from a dual chamber bottle. A most preferred dual chamber bottle comprises one having side-by-side, equal capacity chambers and a single dispensing orifice.

TABLE VIII

| Number of Drains Tested | Number with flows <11.41/min before treatment | Number with flows <11.4 1/min after treatment | Percent Improvement flows <11.4 1/min | Percent Improvement all drains |
|---|---|---|---|---|
| 38 | 18 | 9 | 105.5 | 53.9 |

Table VIII illustrates the specific improvement in slow-flowing drains, i.e. those having flows of less than about 11.4 liters per minute (1/min), following treatment by a formulation of the present invention made according to Example 10 of Table V. The test protocol called for measuring the amount of time taken for 4 liters of cold tap water to drain from the sink. This was performed three times and an average flowrate was calculated. The present invention was then applied to the drain. After one hour the drain was flushed with hot tap water. Again, the amount of time taken for 4 liters of cold tap water to drain from the sink was measured three times and an average flowrate determined. A percent flow improvement was calculated for each drain using the average flowrates obtained before and after application of the present invention. A preferred bottle orientation during pouring results in both liquids exiting the dual chambered container such that optimum foam generation occurs in the drain pipe.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

What is claimed is:

1. An in-situ foaming drain cleaner comprising (a) a first aqueous liquid, having a viscosity of at least about 100 cP, a relative elasticity of about at least about 1 sec/Pa and a relaxation time of at least about 0.3 sec, the first liquid comprising an oxidant, and a surfactant;

(b) a second aqueous liquid, having a viscosity of at least about 50 cP, a relative elasticity of at least about 1 sec/Pa and a relaxation time of at least about 0.1 sec, the second liquid comprising a gas-generating agent and a surfactant; and wherein the second aqueous liquid is denser than the first aqueous liquid and the first and second aqueous liquids are disposed in a dual chamber container such that they are separately maintained prior to forming an admixture during delivery to a drain to be treated, whereupon the admixture generates a foam sufficient for cleaning efficacy and stability.

2. The cleaner of claim 1 wherein:

the first aqueous liquid comprising the oxidant further includes an alkaline pH-adjusting agent, and the second aqueous liquid comprising the gas generating agent further includes an acidic pH adjusting agent.

3. The cleaner of claim 1 wherein the oxidant is present in a stoichiometric amount over the gas-generating agent wherein said excess acts as a drain-opening active.

4. The cleaner of claim 1 and further including a drain opening active in at least one of the first or second aqueous liquids.

5. The cleaner of claim 1 wherein both of the first and second liquids include a betaine surfactant and an aryl sulfonate surfactant.

6. The cleaner of claim 1 and further including:

an alkali metal hydroxide, an alkali metal silicate, an alkali metal carbonate, and an alkali metal chloride in at least one of the first or second aqueous liquids.

7. The cleaner of claim 1, wherein an initial phase of foam is generated at an initial rate of about 10–50 mls/sec, said initial phase lasting no longer than about 60 seconds.

8. The cleaner of claim 7, and further including:

a secondary phase of foam is generated at a secondary rate of about 0.01 to 6 mls/sec, said secondary phase lasting about 20–500 seconds following an end of said initial phase; and a tertiary phase of foam is generated at a tertiary rate of about 0.0001 to negative 0.2 mls/sec, said tertiary phase lasting about 3600 seconds following an end of said secondary phase.

* * * * *